US007927209B2

(12) United States Patent
Gagner et al.

(10) Patent No.: US 7,927,209 B2
(45) Date of Patent: Apr. 19, 2011

(54) WAGERING GAMES WITH POOLING OF AWARDS

(75) Inventors: Mark Gagner, West Chicago, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 1477 days.

(21) Appl. No.: 11/347,076

(22) Filed: Feb. 3, 2006

(65) Prior Publication Data

US 2006/0183536 A1 Aug. 17, 2006

Related U.S. Application Data

(60) Provisional application No. 60/650,498, filed on Feb. 7, 2005.

(51) Int. Cl.
*A63F 9/24* (2006.01)

(52) U.S. Cl. ..... 463/25; 463/26; 463/27; 463/28

(58) Field of Classification Search ..... 463/26, 463/27, 25, 28
See application file for complete search history.

(56) References Cited

U.S. PATENT DOCUMENTS 4,624,459 A 11/1986 Kaufman
4,652,998 A * 3/1987 Koza et al. ..... 463/26
4,837,728 A 6/1989 Barrie et al.
4,948,134 A 8/1990 Suttle et al.
5,116,055 A 5/1992 Tracy
5,249,800 A 10/1993 Hilgendorf et al.
5,275,400 A 1/1994 Weingardt et al.
5,280,909 A 1/1994 Tracy
5,344,144 A 9/1994 Canon
5,377,973 A 1/1995 Jones et al.
5,393,057 A 2/1995 Marnell, II
5,524,888 A 6/1996 Heidel
5,544,892 A 8/1996 Breeding
5,564,700 A * 10/1996 Celona ..... 463/27
5,580,063 A 12/1996 Edwards
5,580,309 A 12/1996 Piechowiak et al.

(Continued)

FOREIGN PATENT DOCUMENTS

DE 19624321 3/2002

(Continued)

OTHER PUBLICATIONS

"Easy Riches" by Sigma Game, Strictly Slots, 1 page (Aug. 2001).

(Continued)

*Primary Examiner* — David L Lewis
*Assistant Examiner* — Chase Leichliter
(74) *Attorney, Agent, or Firm* — Nixon & Peabody LLP

(57) ABSTRACT

Method and system are disclosed for operating wagering game terminals where each terminal contributes an award to an award pool. A bank controller aggregates the awards, reapportions, and randomly assigns them back to the wagering game terminals. The reapportioned award assigned to a given wagering game terminal may be less than, the same as, or greater than the award contributed by that terminal. At regular or irregular intervals, the bank controller may shuffle the reapportioned awards and reassign them. As a result, the volatility of the wagering game terminals increases significantly while the payout percentage of each wagering game terminal remains the same over time. Alternatively, instead of randomly reassigning the reapportioned awards, the players may be allowed to pick the reapportioned awards. The reapportioning may also occur randomly and the assigning on an as-needed basis.

22 Claims, 9 Drawing Sheets

U.S. PATENT DOCUMENTS 5,611,730 A 3/1997 Weiss
5,645,486 A 7/1997 Nagao et al.
5,655,961 A 8/1997 Acres et al.
5,766,076 A 6/1998 Pease et al.
RE35,864 E 7/1998 Weingardt
5,779,549 A 7/1998 Walker et al.
5,816,918 A 10/1998 Kelly et al.
5,823,874 A 10/1998 Adams
5,830,063 A 11/1998 Byrne et al.
5,848,932 A 12/1998 Adams
5,855,515 A 1/1999 Pease et al.
5,876,284 A 3/1999 Acres et al.
5,885,158 A 3/1999 Torango et al.
5,941,773 A 8/1999 Harlick
5,975,528 A 11/1999 Halaby
6,007,427 A 12/1999 Wiener et al.
6,012,982 A 1/2000 Piechowiak et al.
6,039,648 A 3/2000 Guinn et al.
6,047,963 A 4/2000 Pierce et al.
6,077,162 A * 6/2000 Weiss ..... 463/26
6,089,977 A 7/2000 Bennett
6,089,980 A 7/2000 Gauselmann et al.
6,102,474 A 8/2000 Daley
6,102,798 A 8/2000 Bennett et al.
6,102,799 A 8/2000 Stupak
6,110,043 A 8/2000 Olsen
6,139,013 A 10/2000 Pierce et al.
6,142,872 A 11/2000 Walker et al.
6,146,273 A 11/2000 Olsen
6,155,925 A 12/2000 Giobbi et al.
6,158,741 A 12/2000 Koelling
6,159,097 A 12/2000 Gura
6,168,523 B1 1/2001 Piechowiak et al.
6,203,010 B1 3/2001 Jorasch et al.
6,206,374 B1 3/2001 Jones
6,206,782 B1 3/2001 Walker et al.
6,210,275 B1 4/2001 Olsen
6,210,277 B1 4/2001 Stefan
6,217,448 B1 4/2001 Olsen
6,220,593 B1 4/2001 Pierce et al.
6,224,482 B1 5/2001 Bennett et al.
6,224,484 B1 5/2001 Okuda et al.
6,231,445 B1 * 5/2001 Acres ..... 463/42
6,254,483 B1 7/2001 Acres
6,312,332 B1 11/2001 Walker et al.
6,315,660 B1 11/2001 DeMar et al.
6,319,125 B1 11/2001 Acres
6,319,127 B1 11/2001 Walker et al.
6,336,859 B2 1/2002 Jones et al.
6,336,862 B1 1/2002 Byrne et al.
6,345,824 B1 2/2002 Selitzky
6,358,149 B1 3/2002 Schneider et al.
6,361,441 B1 3/2002 Walker et al.
6,364,768 B1 4/2002 Acres et al.
6,375,567 B1 4/2002 Acres
6,375,568 B1 4/2002 Roffman et al.
6,416,408 B2 7/2002 Tracy et al.
6,416,409 B1 * 7/2002 Jordan ..... 463/27
6,422,940 B1 7/2002 Walker et al.
6,431,983 B2 8/2002 Acres
6,435,968 B1 8/2002 Torango
6,439,995 B1 8/2002 Hughs-Baird et al.
6,482,089 B2 11/2002 DeMar et al.
6,506,117 B2 1/2003 DeMar et al.
6,508,707 B2 1/2003 DeMar et al.
6,517,433 B2 2/2003 Loose et al.
6,520,855 B2 2/2003 DeMar et al.
6,589,115 B2 7/2003 Walker et al.
6,592,460 B2 7/2003 Torango
6,599,186 B1 7/2003 Walker et al.
6,599,188 B2 7/2003 Hirsch et al.
6,599,193 B2 7/2003 Baerlocher et al.
6,609,973 B1 8/2003 Weiss
6,648,753 B1 11/2003 Tracy et al.
6,648,762 B2 11/2003 Walker et al.
6,692,354 B2 2/2004 Tracy et al.
6,712,695 B2 3/2004 Mothwurf et al.
6,712,699 B2 3/2004 Walker et al.
6,733,390 B2 5/2004 Walker et al.
6,790,141 B2 9/2004 Muir et al.
6,837,793 B2 1/2005 McClintic
6,857,959 B1 * 2/2005 Nguyen ..... 463/25
6,887,159 B2 5/2005 Leen et al.
2002/0138594 A1 9/2002 Rowe
2002/0151345 A1 10/2002 Byrne
2002/0155874 A1 10/2002 Byrne
2003/0027618 A1 2/2003 Byrne
2003/0036430 A1 2/2003 Cannon
2003/0045337 A1 3/2003 Byrne
2003/0047874 A1 3/2003 Leen et al.
2003/0050106 A1 3/2003 Lyfoung
2003/0064776 A1 4/2003 Byrne
2003/0064807 A1 4/2003 Walker et al.
2003/0114218 A1 6/2003 McClintic
2003/0119576 A1 6/2003 McClintic et al.
2003/0148808 A1 8/2003 Price
2003/0181231 A1 9/2003 Vancura et al.
2003/0186733 A1 10/2003 Wolf et al.
2003/0216166 A1 11/2003 Baerlocher et al.
2003/0222402 A1 12/2003 Olive
2003/0224852 A1 12/2003 Walker
2003/0228899 A1 12/2003 Evans
2003/0236116 A1 12/2003 Marks et al.
2004/0009808 A1 1/2004 Gauselmann
2004/0009811 A1 1/2004 Torango
2004/0038741 A1 2/2004 Gauselmann
2004/0048644 A1 3/2004 Gerrard et al.
2004/0053682 A1 * 3/2004 Nelson et al. ..... 463/25
2004/0087368 A1 5/2004 Gauselmann
2004/0106448 A1 6/2004 Gauselmann
2004/0132524 A1 7/2004 Ramstad et al.
2004/0204226 A1 10/2004 Foster et al.
2004/0204235 A1 10/2004 Walker et al.
2004/0235552 A1 11/2004 Gauselmann
2004/0242297 A1 12/2004 Walker et al.
2004/0242303 A1 12/2004 Walker et al.
2005/0014554 A1 1/2005 Walker et al.
2005/0026674 A1 2/2005 Wolf et al.
2005/0119044 A1 * 6/2005 Lim et al. ..... 463/25
2005/0148382 A1 7/2005 Fox
2005/0187008 A1 8/2005 Nakajima
2005/0192073 A1 9/2005 Nakajima
2005/0239542 A1 * 10/2005 Olsen ..... 463/27
2005/0282628 A1 12/2005 Beatty et al.
2006/0160612 A1 * 7/2006 Parham et al. ..... 463/25

FOREIGN PATENT DOCUMENTS

DE 19515983 4/2003
EP 0521599 1/1993
GB 2153572 8/1985
GB 2181589 4/1987
GB 2242300 9/1991
GB 2313792 12/1997
GB 2333880 8/1999
WO WO-9903078 1/1999
WO WO-9919037 4/1999
WO WO-0133478 5/2001
WO WO-03026754 4/2003
WO WO-03083789 10/2003

OTHER PUBLICATIONS

"Millioniser" by Glenn Haussman, Strictly Slots, pp. 50-53 (Mar. 2004).
"Big Games Safari", IGT, 24 pages (2000).
"New '97 Games", International Gaming & Wagering Business, 24 pages (Mar. 1997).

* cited by examiner

WAGERING GAMES WITH POOLING OF AWARDS

CROSS-REFERENCE TO RELATED APPLICATION

This application claims priority to, and hereby incorporates by reference, U.S. Provisional Application No. 60/650,498, entitled "Wagering Games with Pooling of Awards," filed Feb. 7, 2005, with the United States Patent and Trademark Office.

FIELD OF THE INVENTION

The present invention relates generally to wagering game terminals and, more particularly, to a method and system of conducting game play in which awards at multiple wagering game terminals are pooled to increase the volatility of the wagering game terminals.

BACKGROUND OF THE INVENTION

Wagering game terminals, such as slot machines, video poker machines, and the like, have been a cornerstone of the gaming industry for several years. Generally, the popularity of such terminals among players depends on the perceived likelihood of winning money at the terminal and the intrinsic entertainment value of the terminal relative to other available gaming options. Where the available gaming options include a number of competing terminals and the expectation of winning each terminal is roughly the same (or believed to be the same), players are most likely to be attracted to the more entertaining and exciting terminal. Consequently, wagering game terminal operators strive to employ the most entertaining and exciting terminals available because such terminals attract frequent play and, hence, increase profitability for the operators. Thus, in the highly competitive wagering game terminal industry, there is a continuing need to develop new types of games, or improvements to existing games, that will enhance the entertainment value and excitement associated with the games.

One concept that has been successfully employed in existing wagering game terminals to enhance player entertainment is a secondary or "bonus" game played in conjunction with a "basic" game. The bonus game may include any type of game, either similar to or entirely different from the basic game, and is initiated by the occurrence of certain pre-selected events or outcomes in the basic game. The addition of such a bonus game has been found to produce a significantly higher level of player excitement than the basic game alone because it provides an additional chance to play, which increases the player's overall expectation of winning.

Another concept that is often employed in the gaming industry is the use of progressive games. A "progressive" game involves collecting coin-in data from participating wagering game terminals (e.g., slot machines), contributing a percentage of that coin-in to a progressive jackpot amount, and awarding that jackpot amount to a player upon the occurrence of a certain jackpot-won event. A jackpot-won event typically occurs when a "progressive winning position" is achieved at a participating wagering game terminal. If the wagering game terminal is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the wagering game terminals without winning the jackpot. Further, when several wagering game terminals are linked together such that several players compete for the same jackpot, the jackpot progressively increases at a much faster rate, which leads to further player excitement.

Progressive jackpots create a type of dynamic award pool in which the size of the award varies depending on the number of wagering game terminals contributing to the pool, the time the pool has been accumulating, and the credit amounts contributed. The progressive award pool, however, is generally funded by siphoning a fixed percentage of the total coin-in from each participating wagering game terminal. Thus, the funds going into the progressive pool are not accounted for in the same way as the funds going into the pay tables of the basic game. As a result, a progressive payout effectively represents a reduction in the casino operator's profit. Many operators compensate for this reduction in profit by lowering the payout percentage of the basic game in participating wagering game terminals. The decreased payout percentage, however, may reduce the enjoyment and excitement of the gaming experience for some players.

Accordingly, what is needed is a wagering game terminal that provides increased enjoyment and excitement over existing wagering game terminals. More specifically, what is needed is a way of creating dynamic award pools where no siphoning of a percentage of the total coin-in from participating wagering game terminals is required.

SUMMARY OF THE INVENTION

The present invention is directed to a method and system for operating wagering game terminals that provide increased excitement and enjoyment over existing wagering game terminals. The method and system of the invention involve a bank of wagering game terminals connected to a bank controller. Each wagering game terminal in the bank contributes an award, preferably its highest award, to an award pool managed by the bank controller. The bank controller aggregates the contributed awards, reapportions them, and randomly assigns them back to the wagering game terminals. The award assigned to a given wagering game terminal may be less than, the same as, or greater than the award contributed by that terminal. At regular or irregular intervals, the bank controller may shuffle the reapportioned awards and reassign them. As a result, the volatility of the wagering game terminals increases significantly while the payout percentage of each wagering game terminal remains the same over time. Alternatively, instead of randomly assigning the reapportioned awards, the players may be allowed to pick the reapportioned awards. The reapportioning may also occur randomly and the assigning on an as-needed basis.

In general, in one aspect, the invention is directed to a wagering game system. The system comprises a plurality of wagering game terminals connected to a network. Each wagering game terminal is capable of conducting a wagering game in which an outcome is randomly selected from a plurality of outcomes, and each wagering game terminal contributing a predetermined award to the network. The system further comprises a network controller for aggregating awards contributed by the wagering game terminals into an award pool. The network controller is configured to reapportion the awards and to randomly assign reapportioned ones of the awards to the wagering game terminals. The network controller reapportions the awards by increasing a credit amount of some awards and decreasing a credit amount of other awards while keeping a total credit amount in the award pool fixed.

In general, in another aspect, the invention is directed to a method of increasing volatility in wagering game terminals. The method comprises the step of pooling awards from the wagering game terminals into an award pool and reapportioning the awards in the award pool such that some awards are increased while other awards are decreased, but a total credit amount in the award pool remains fixed. Reapportioned ones of the awards are randomly selected for the wagering game terminals such that each wagering game terminal may receive a reapportioned award that is less than, the same as, or greater than an award contributed by the wagering game terminal.

In general, in still another aspect, the invention is directed to a wagering terminal. The wagering game terminal comprises a wager input device for accepting a wager from a player at the wagering game terminal and a display unit for displaying a wagering game having an outcome that is randomly selected from a plurality of outcomes. The wagering game terminal further comprises a controller for controlling the display unit, the controller causing the display unit to display a plurality of awards corresponding to a predetermined payout scheme of the wagering game terminal. At least one of the awards is replaced on the display unit with a variable credit symbol representing a variable credit amount that is determined by an external source and subsequently used by the wagering game terminal as part of the predetermined payout scheme.

The above summary of the present invention is not intended to represent each embodiment, or every aspect, of the present invention. The detailed description and figures will describe many of the embodiments and aspects of the present invention.

BRIEF DESCRIPTION OF THE DRAWINGS

The foregoing and other advantages of the invention will become apparent upon reading the following detailed description and upon reference to the drawings, wherein.

Figure 1:
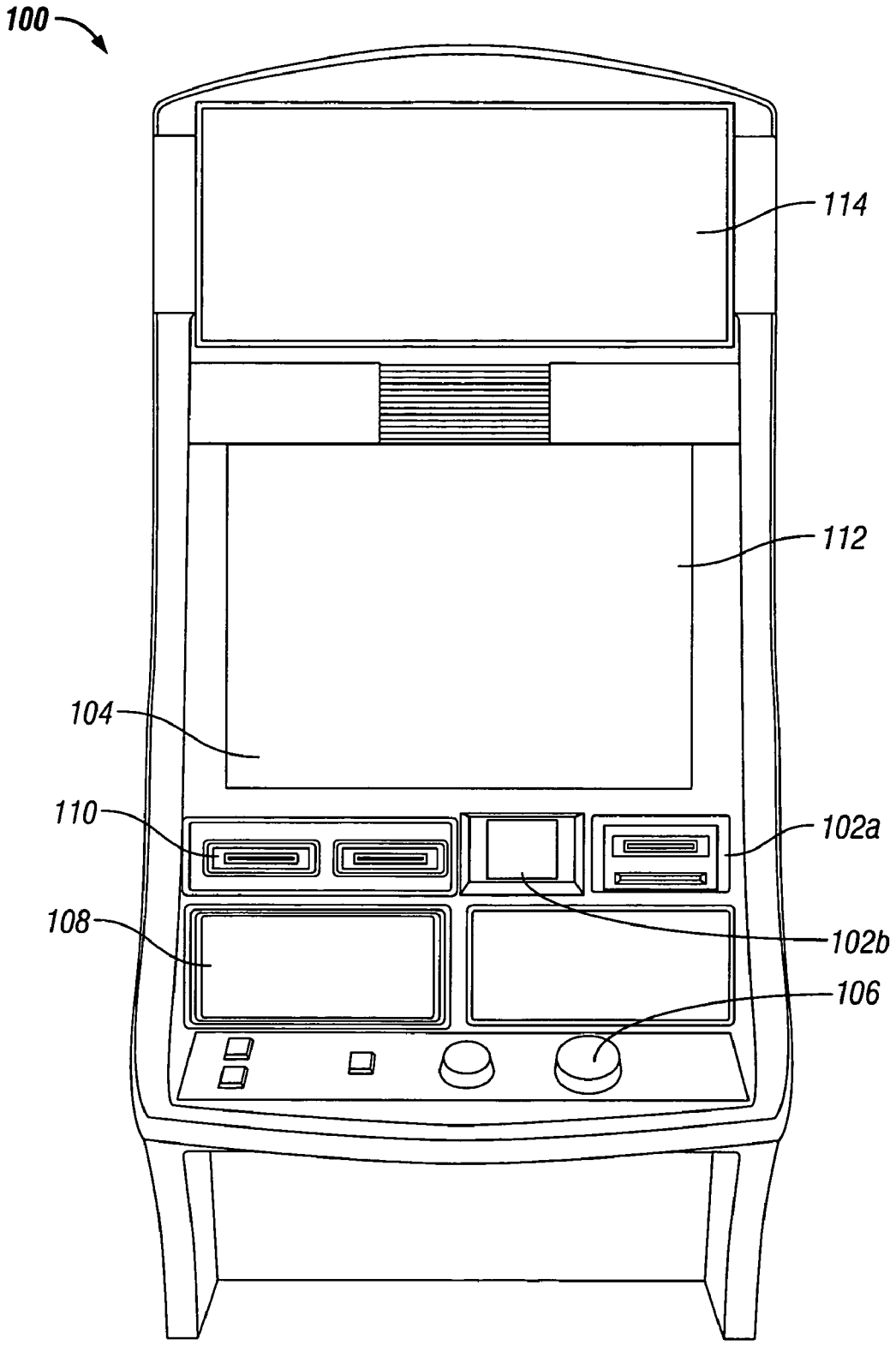
FIG. 1 illustrates a perspective view of a wagering game terminal according to one embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As alluded to above, embodiments of the invention provide a system and method for playing a wagering game where several wagering game terminals contribute one of their awards to an award pool. Preferably, the award contributed by each wagering game terminal is the highest award for that wagering game terminal, but a lower award may certainly be used. Each contributed award may be a basic game award, a bonus game award, or some other award. The contributed awards are aggregated and reapportioned, then randomly assigned back to the wagering game terminals so that each terminal has an award that may be a different credit amount than the award contributed. The total credit amount in the award pool, however, remains fixed. The result is that the volatility of each wagering game terminal increases significantly, but the payout percentage remains the same over time.

FIG. 1 shows a perspective view of an exemplary wagering game terminal 100 according to embodiments of the invention. The wagering game terminal 100 may be operated as a stand-alone terminal, or it may be connected to a network of wagering game terminals. Further, the wagering game terminal 100 may be any type of wagering game terminal and may have varying structures and methods of operation. For example, the wagering game terminal 100 may be a mechanical wagering game terminal configured to play mechanical slots, or it may be an electromechanical or electrical wagering game terminal configured to play a video casino game, such as blackjack, slots, keno, poker, etc. In the example shown, the wagering game terminal 100 is a video slot machine.

As shown, the wagering game terminal 100 includes input devices, such as a wager acceptor 102 (shown as a card wager acceptor 102*a* and a cash wager accepter 102*b*), a touch screen 104, a push-button panel 106, a payout mechanism 108, and an information reader 110. The wagering game terminal 100 further includes a main display 112 for displaying information about the basic wagering game and, in some embodiments, a secondary display 114 for displaying a pay table and/or game-related information or other entertainment features. While these typical components found in the wagering game terminal 100 are described briefly below, it should be understood that numerous other elements may exist and may be used in any number of combinations to create variations of the wagering game terminal 100.

The wager acceptors 102*a* and 102*b* may be provided in many forms, individually or in combination. For example, the cash wager acceptor 102*a* may include a coin slot acceptor or a note acceptor to input value to the wagering game terminal 100. The card wager acceptor 102*b* may include a card-reading device for reading a card that has a recorded monetary value with which it is associated. The card wager acceptor 102*b* may also receive a card that authorizes access to a central account that can transfer money to the wagering game terminal 100.

The payout mechanism 108 performs the reverse function of the wager acceptors 102*a* and 102*b*. For example, the payout mechanism 108 may include a coin dispenser or a note dispenser to dispense money or tokens from the wagering game terminal 100. The payout mechanism 108 may also be adapted to receive a card that authorizes the wagering game terminal 100 to transfer credits from the wagering game terminal 100 to a central account.

The push button panel 106 is typically offered, in addition to the touch screen 104, to provide players with an option on making their game selections. Alternatively, the push button panel 106 may facilitate player input needed for certain aspects of operating the game, while the touch screen 104 facilitates player input needed for other aspects of operating the game.

The outcome of the basic wagering game is displayed to the player on the main display 112. The main display 112 may take a variety of forms, including a cathode ray tube (CRT), a high resolution LCD, a plasma display, LED, or any other type of video display suitable for use in the wagering game terminal 100. As shown here, the main display 112 also includes the touch screen 104 overlaying the entire display (or a portion thereof) to allow players to make game-related selections. Alternatively, the wagering game terminal 100 may include a number of mechanical reels that display the game outcome.

In some embodiments, the information reader 110 is a card reader that allows for identification of a player by reading a card with information indicating the player's identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 110, which allows the casino's computers to register that player's wagers at the wagering game terminal 100. Then, the wagering game terminal 100 may use the secondary display 114 for providing the player with information about his or her account or other player-specific information. Also, in some embodiments, the information reader 110 may be used to restore game assets that the player acquired during a previous gaming session and had saved.

Figure 2:
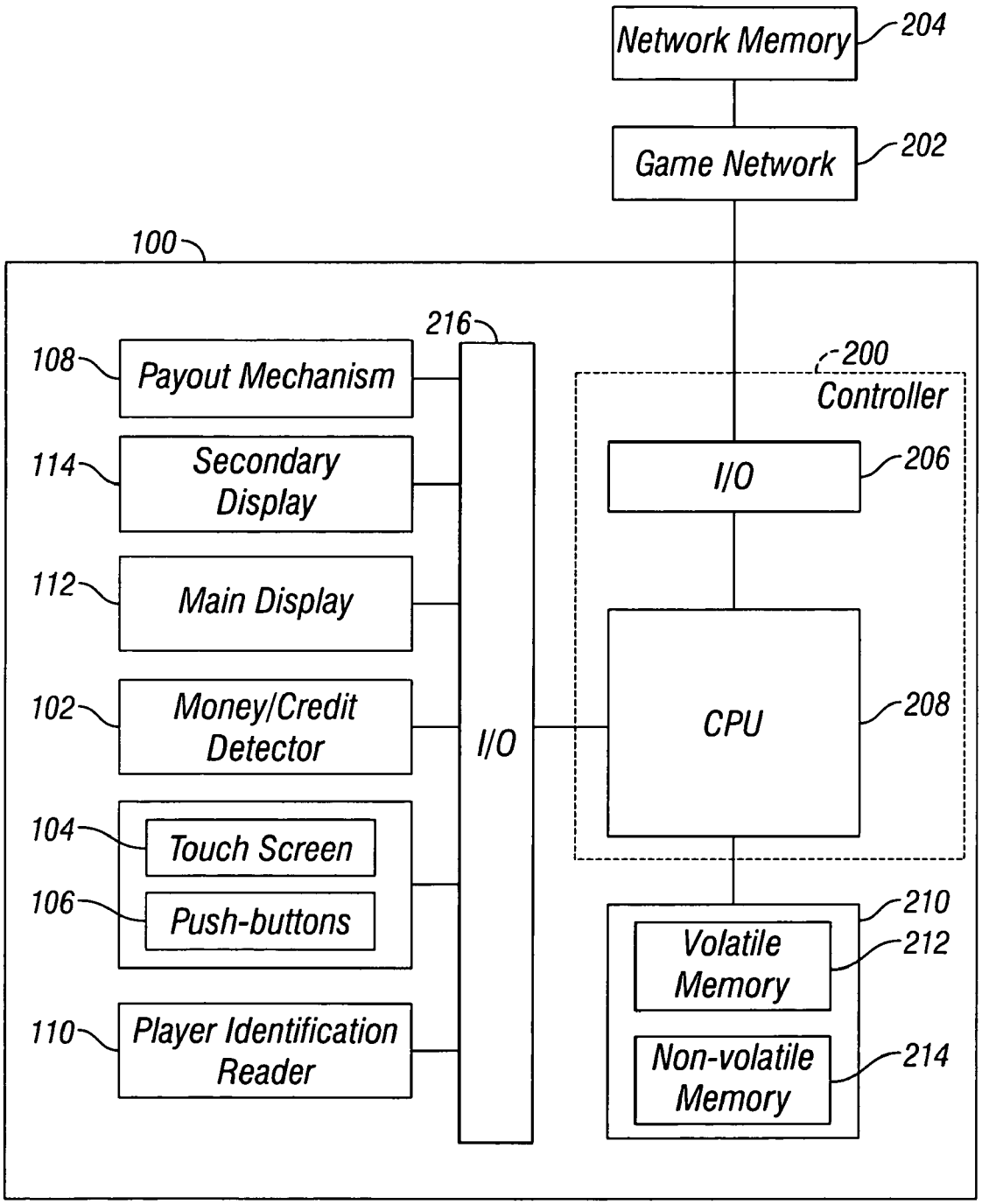
FIG. 2 illustrates the wagering game terminal of FIG. 1 in more detail.

As shown in FIG. 2, the wagering game terminal 100 and associated wagering game control system is capable of executing wagering games on or through a controller 200. The controller 200, as used herein, comprises any combination of hardware, software, and/or firmware that may be disposed or resident inside and/or outside of a wagering game terminal 100 or like machine which may communicate with and/or control the transfer of data between the wagering game terminal 100 and a bus, another computer, processor, or device, and/or a service and/or a network. Such a network is shown at 202 and may include, but is not limited to a peer-to-peer, client/server, master/slave, star network, ring network, bus network, or other network architecture wherein at least one processing device (e.g., computer) is linked to at least one other processing device. A network memory 204 is connected to the network 202 for storing data and/or information transferred over the network 202, including game asset data and information.

The controller 200 may comprise the I/O circuits 206 and a CPU 208. In other embodiments, the CPU 208 may be housed outside of the controller 200, and a different processor may be housed within the controller 200. The controller 200, as used herein, may comprise multiple CPUs 208. In one implementation, each wagering game terminal 100 comprises, or is connected to, a controller 200 enabling each wagering game terminal 100 to transmit and/or receive signals, preferably both, in a peer-to-peer arrangement. In another example, the controller 200 may be adapted to facilitate communication and/or data transfer for one or more wagering game terminals 100 in a client/server or centralized arrangement. In one aspect, shown in FIG. 2, the controller 200 may connect the wagering game terminal 100 via a conventional I/O port and communication path (e.g., serial, parallel, IR, RC, 10bT, etc.) to the game network 202, which may include, for example, other wagering game terminals connected together in the network 202.

To provide the wagering game functions, the controller 200 executes a game program that generates a randomly selected game outcome. The controller 200 is also coupled to or includes a local memory 210. The local memory 210 may be in the form of one or more volatile memories 212 (e.g., a random-access memory (RAM)) and one or more non-volatile memories 214 (e.g., an EEPROM). Communication between the peripheral components of the wagering game terminal 100 and the controller 200 is controlled by the controller 200 through input/output (I/O) circuits 216.

Figure 3A:
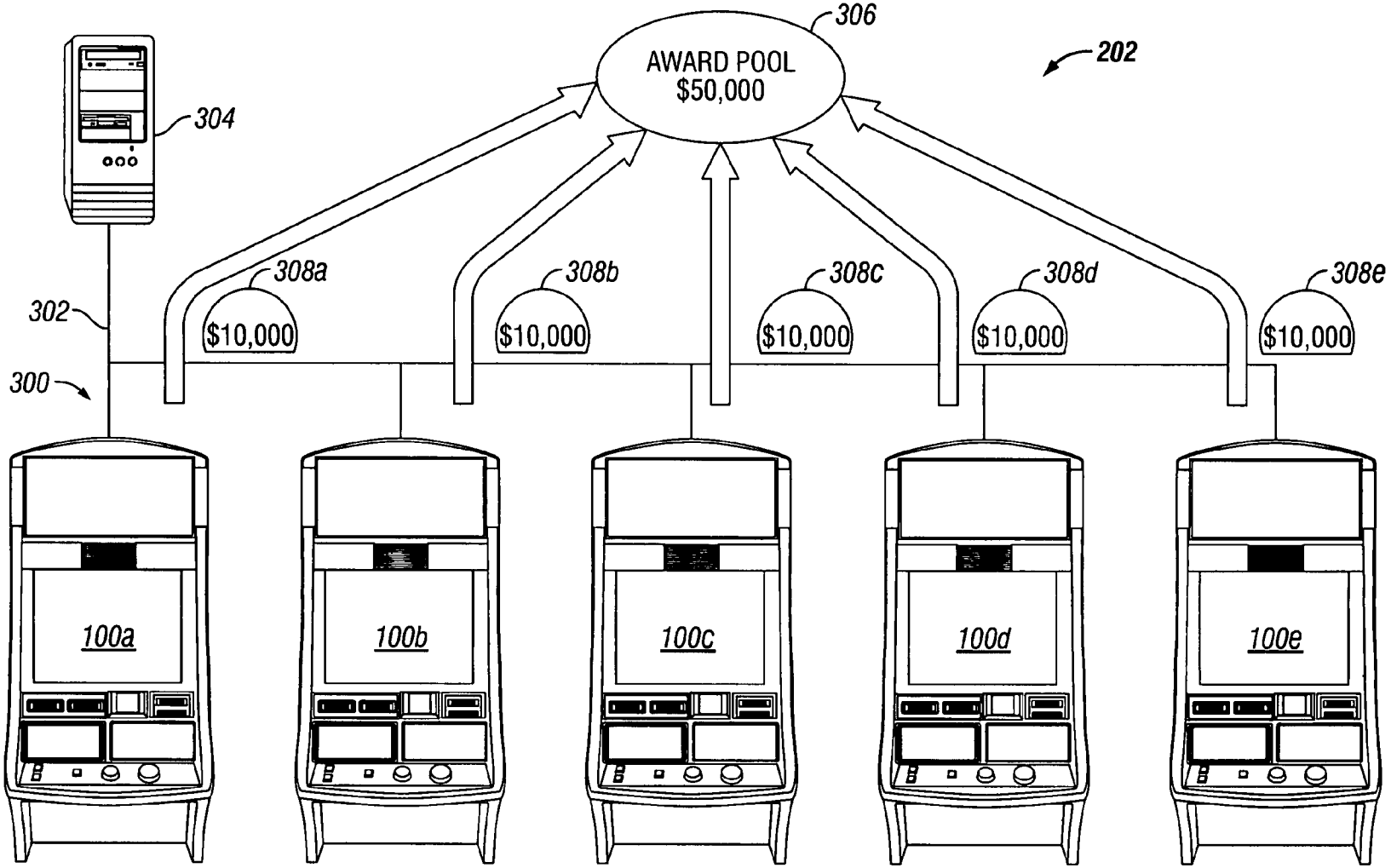
FIGS. 3A-3B illustrate a bank of wagering game terminals in which awards are aggregated and reapportioned according to one embodiment of the invention.

As mentioned above, the wagering game terminal 100 may be a stand-alone terminal, or it may be part of the network 202 that connects multiple wagering game terminals 100 together. FIG. 3A illustrates an exemplary implementation where several wagering game terminals 100 are connected together over the network 202. The network 202 includes a bank 300 of wagering game terminals 100*a*, 100*b*, 100*c*, 100*d*, and 100*e* connected via network connections 302 (e.g., Ethernet, TCP/IP) to a bank controller 304. Although only five wagering game terminals 100*a-e* are shown here, those having ordinary skill in the art will recognize that the bank 300 may include fewer or more wagering game terminals without departing from the scope of the invention.

The wagering game terminals 100*a-e* are similar to the wagering game terminal 100 (FIG. 1) in that they have many of the same features and components. For example, the wagering game terminals 100*a-e* allow players to play a basic and a bonus wagering game. Each wagering game terminal 100*a-e* may be configured to play a different basic and/or bonus wagering game, or they all may be configured to play the same basic and/or bonus wagering game. Furthermore, the wagering game terminals 100*a-e* may share a common theme, such as a pirate ship theme, or each wagering game terminal 100*a-e* may have its own theme that is different from the other wagering game terminals 100*a-e*.

In some embodiments, one or more functions of the wagering game terminals 100*a-e* may reside on the bank controller 304 instead of, or in addition to, the wagering game terminals 100*a-e*. A computer readable medium (e.g., magnetic, optical, or other data storage devices, not expressly shown) connected to the bank controller 304 contains encoded instructions for directing the bank controller 304 to perform various operations associated with the wagering game terminals 100*a-e*. The bank controller 304 may then conduct the basic and/or bonus games (or portions thereof) for each of the wagering game terminals 100*a-e* connected to the network 202, including providing the input data and information needed to operate the basic and/or bonus games. The bank controller 304 may also control one or more progressive jackpots that are contributed to by all or some of the wagering game terminals 100*a-e* in the bank 300 (e.g., terminal-level jackpots that each terminal 100*a-e* contributes to individually, bank-level jackpots that are contributed to by all of the terminals 100*a-e* in a particular bank, and wide-area jackpots that are contributed to by a larger number of terminals 100*a-e*, such as multiple banks 300).

In accordance with embodiments of the invention, the computer readable medium of the bank controller 304 contains encoded instructions for directing the bank controller 304 to create an award pool 306 for the wagering game terminals 100*a-e* connected to the bank 300. Each wagering game terminal 100*a-e* then contributes one of its awards 308*a-e*, for example, a basic game award, a bonus game award, or some other award, to the award pool 306. The contributions to the award pool 306 may occur, for example, by having the bank controller 304 interrogate the wagering game terminals 100*a-e* shortly after a new wagering game terminal 100*a-e* joins the bank 300. The contributed award 308*a-e* from each wagering game terminal 100*a-e* are subsequently aggregated and reapportioned by the controller 304. In the example shown, five wagering game terminals 100*a-e* are connected to the bank 300, with each wagering game terminal 100*a-e* contributing its top basic game award 308*a-e* of 10,000 credits, resulting in an award pool 306 with an aggregate value of 50,000 credits.

The reapportioning may be performed by a reapportioning algorithm executable by the bank controller 304. The reapportioning algorithm increases the size of some awards and decreases the size of other awards such that few or no awards retain their original credit amounts, but the total credit amount in the award pool 306 remains the same as the credit amount originally contributed (i.e., 50,000 credits). The result of the reapportioning algorithm is that some reapportioned awards are smaller than the smallest credit amount contributed, while other reapportioned awards are larger than the largest credit amount contributed.

Moreover, the reapportioning algorithm may produce the same number of reapportioned awards as originally contributed awards or a different number of reapportioned awards, provided that the total credit amount in the award pool 306 remains the same as the credit amount originally contributed. In the event that a wagering game terminal 100*a-e* is either added to or removed from the bank 300 such that the total credit amount in the award pool 306 changes, then the bank controller 304 is configured to repeat the aggregation and reapportioning of the award pool 306 to accommodate the change in the award pool 306.

In some embodiments, a lower and/or an upper limit may be implemented to limit the size of the smallest and/or largest reapportioned awards relative to the originally contributed awards 308*a-e*. For example, the lower and/or upper limit may require that the reapportioned award 310*a-e* may not be smaller than a predetermined percentage of the originally contributed award 308*a-e* and/or larger than a predetermined percentage of the originally contributed award 308*a-e*. Alternatively, the lower and/or upper limit may require that a reapportioned award 310*a-e* may be smaller than a predetermined percentage of the smallest of the contributed awards 308*a-e* and/or larger than a predetermined percentage of the largest of the contributed awards 308*a-e*.

Figure 3B:
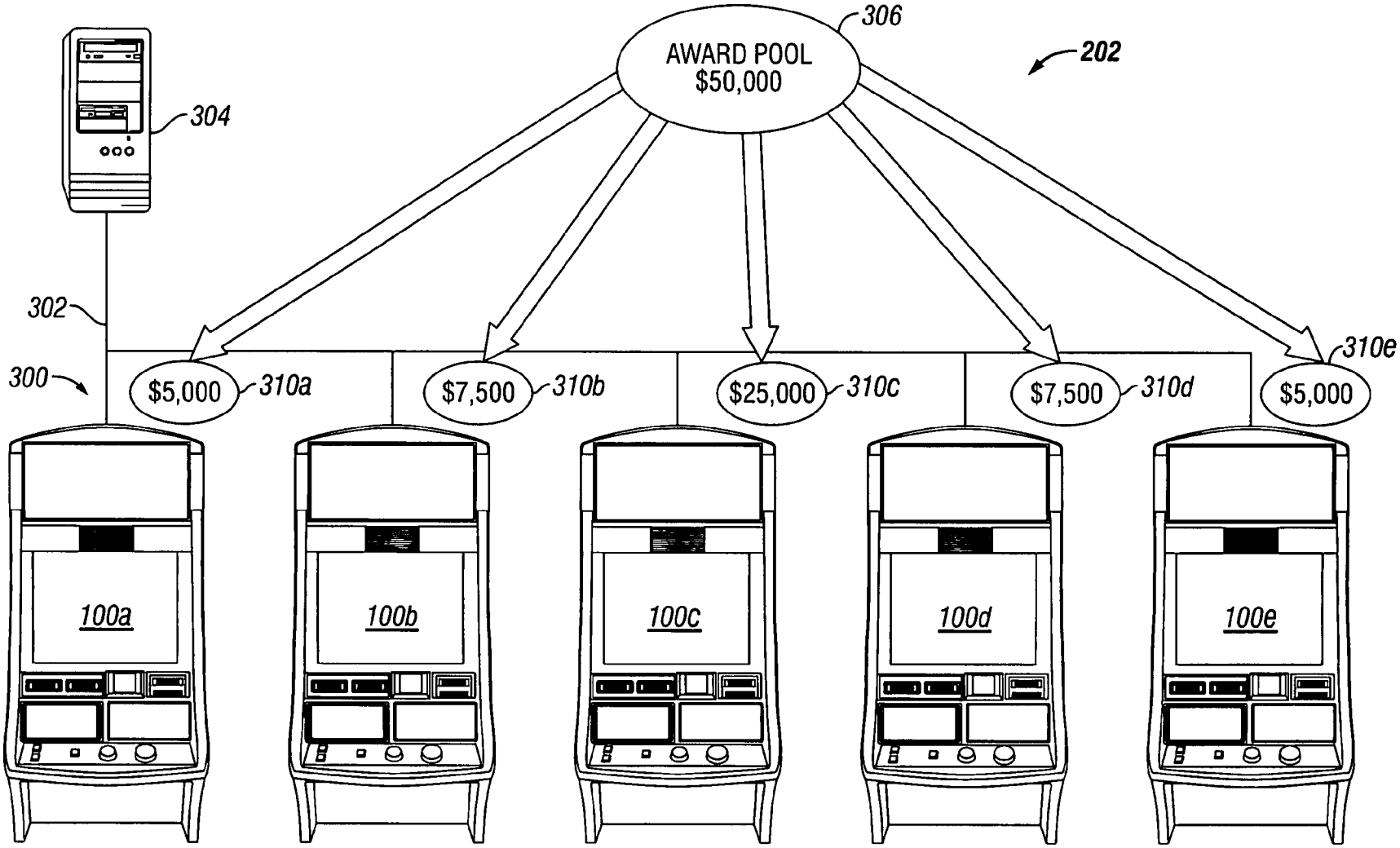

Once the reapportioning is completed, the bank controller 304 randomly assigns the reapportioned awards to the wagering game terminals 100*a-e*. This is illustrated in FIG. 3B, where each wagering game terminal 100*a-e* is randomly assigned a reapportioned award 310*a-e* that takes the place of the originally contributed award 308*a-e* in the operation of the wagering game terminal 100*a-e*. The reapportioned award 310*a-e* that is assigned to each wagering game terminal 100*a-e* may then be prominently displayed on either the main display 112 or the secondary display 114 of each wagering game terminal 100*a-e* for the player to see. It is also possible to keep the assigned reapportioned award 310*a-e* hidden from the player, or to display it as a symbol or variable, until such time when the player actually achieves the corresponding winning outcome on his or her wagering game terminal 100*a-e*.

Note that an award represents the maximum credit amount that a player may receive for a particular winning outcome. The credit amount actually given to the player, however, may be prorated based on the number of credits wagered according to the rules for the wagering game. The award may be associated with a particular winning outcome, for example, one of the pay table awards, or it may be associated with a bonus game outcome, or it may be a random award that is unrelated to any outcome. In some embodiments, multiple pay table awards associated with multiple basic game outcomes may be contributed. Where a pay table award is contributed, the contributing wagering game terminal 100*a-e* should inform the player that a variable credit amount is associated with that particular pay table award and not a fixed credit amount.

To prevent a wagering game terminal 100*a-e* from exceeding or falling below its payout percentage over time due to the reapportioning of the awards, the bank controller 304 is configured to randomly redistribute or shuffle the reapportioned awards 310*a-e* at regular or possibly irregular intervals (e.g., every 100 handle pulls, every 60 seconds, etc.) and to randomly reassign the awards to the wagering game terminals 100*a-e*. Alternatively, instead of shuffling, it is also possible to simply repeat the reapportioning, then randomly reassign the newly reapportioned awards to the wagering game terminals 100*a-e*. The shuffling/reapportioning and reassignment give each wagering game terminal 100*a-e* a substantially equal chance of eventually being assigned a reapportioned award 310*a-e* that is higher or lower than its originally contributed award 308*a-e*. In some embodiments, however, it is possible for some wagering game terminals 100*a-e* to have a higher or lower chance of being assigned certain reapportioned awards 310*a-e*, depending on the relative contributions of the wagering game terminals 100*a-e*.

A result of the reapportioning is that the volatility of each wagering game terminal 100*a-e* may be significantly increased. That is, there may be enormous differences in the sizes of the reapportioned awards 310*a-e* assigned to a given wagering game terminal 100*a-e*, depending on the number of wagering game terminals 100*a-e* connected to the bank 300 and the total credit amount in the award pool 306. Nevertheless, each wagering game terminal 100*a-e* is able to satisfy its respective payout percentage over time, since the probability of receiving a higher or lower reapportioned award 310*a-e* is substantially the same for all wagering game terminals 100*a-e*, and since the total credit amount in the award pool 306 remains equal to the credit amount originally contributed regardless of how the individual awards are reapportioned. Thus, no expected value is lost for any wagering game terminal 100*a-e* or for the entire bank 300 of wagering game terminals 100*a-e*.

Preferably, the award pool 306 is associated with a particular award 308*a-e* or winning outcome for all wagering game terminals 100*a-e* in the bank 300 so that all wagering game terminals 100*a-e* contribute the same awards 308*a-e*. However, it is possible for some wagering game terminals 100*a-e* to contribute an award 308*a-e* that is different from other wagering game terminals 100*a-e*, for example, where not all wagering game terminals 100*a-e* have the same payout scheme. In that case, an algorithm or set of rules may be employed to normalize the assigned reapportioned awards 310*a-e* based on each wagering game terminal's relative contributions to the award pool 306, as will be described further below.

Figure 4:
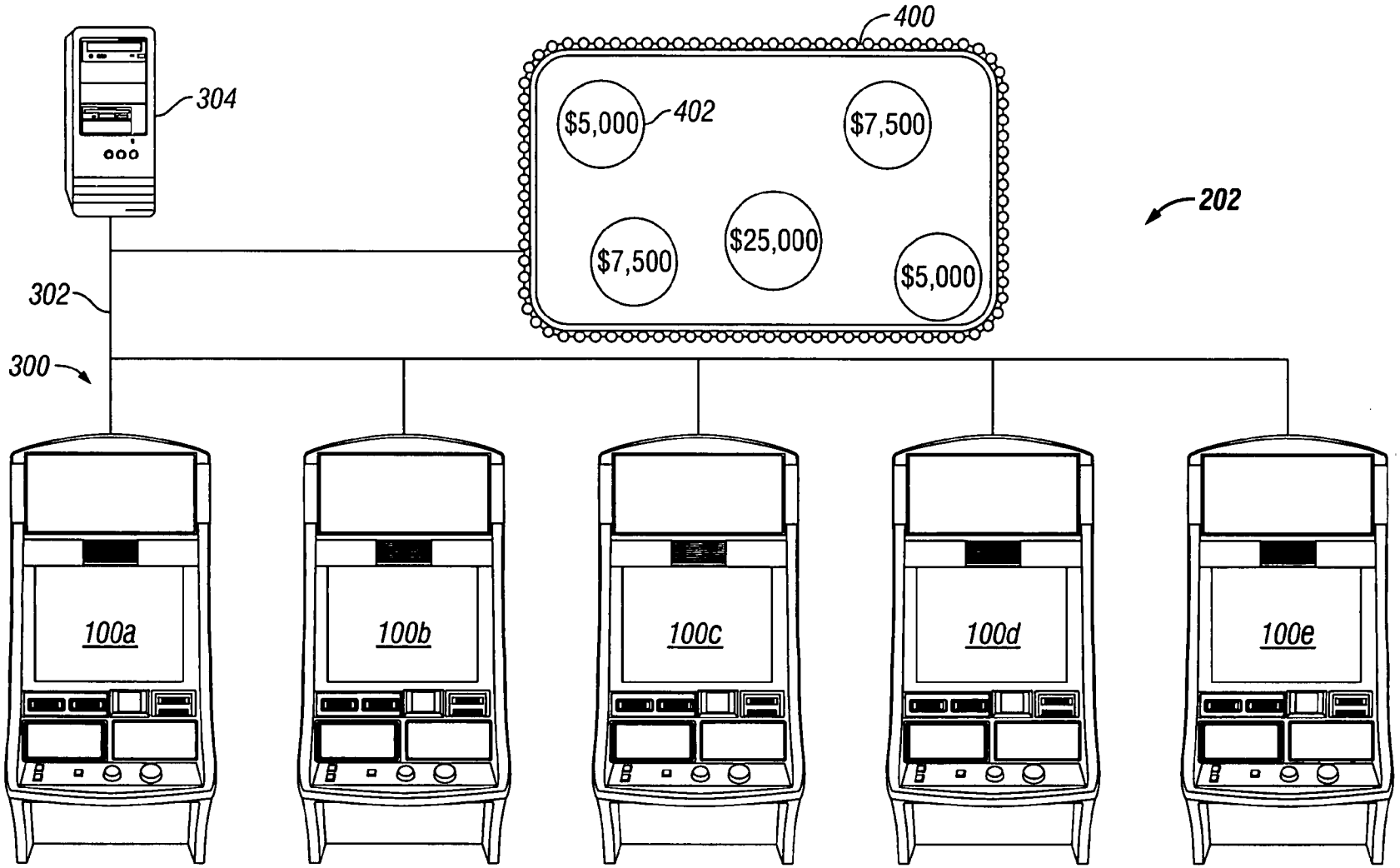
FIG. 4 illustrates an exemplary signage showing reapportioned awards according to one embodiment of the invention.

In some embodiments, the bank controller 304 does not randomly assign the reapportioned awards 310*a-e* to the wagering game terminals 100*a-e* all at once. Instead, the random assignment is performed as needed when a player at one of the wagering game terminals 100*a-e* achieves a certain winning outcome. This embodiment is illustrated in FIG. 4, where signage 400 has been added to the bank 300 of wagering game terminals 100*a-e* to display the award pool 306 from which a reapportioned award 310*a-e* may be randomly assigned. As can be seen, the signage 400 is connected to and controlled by the bank controller 304 and is mounted in a prominent position (e.g., above the bank 300) so that all players at the wagering game terminals 100*a-e* (which are themselves located near one another) and any bystanders may observe the award pool 306.

In the embodiment above, the reapportioned awards 310*a-e* may be displayed in the signage 400 as various theme objects. For example, the reapportioned awards 310*a-e* may be displayed as balls or bubbles 402 that bounce or drift randomly in the signage 400. Each time an appropriate winning outcome is achieved at a wagering game terminal 100*a-e*, the bank controller 304 randomly selects one of the reapportioned awards 310*a-e* for that wagering game terminal 100*a-e* and notifies the player thereof accordingly. In this way, each wagering game terminal 100*a-e* has an equal opportunity of being assigned any one of the reapportioned awards 310*a-e* when an appropriate winning outcome is achieved. Consequently, shuffling and/or reapportioning of the reapportioned awards 310*a-e* is not needed. It may still be desirable, however, to regularly or irregularly reapportion the awards 310*a-e* in order to increase the volatility of the wagering game terminals 100*a-e*.

In some embodiments, it is also possible to let the players randomly select the reapportioned award 310*a-e* instead of the bank controller 304 doing so. In these embodiments, the bank controller 304 may cause the wagering game terminals 100*a-e* to present the player with the reapportioned awards 310*a-e* and allow the player to pick. The reapportioned awards 310*a-e* may be presented as theme objects that are displayed on the signage 400 as well as on the main display 112 (or on the secondary display 114) of the player's wagering game terminal 100*a-e*. Each theme object, when selected by the player, reveals one of the available reapportioned awards 310*a-e* that may then be used for a winning outcome on that wagering game terminal 100*a-e*. As before, no shuffling or reapportioning of the reapportioned awards 310*a-e* is necessary, although it may be desirable to regularly or irregularly reapportion the awards 310*a-e*.

Figure 5A:
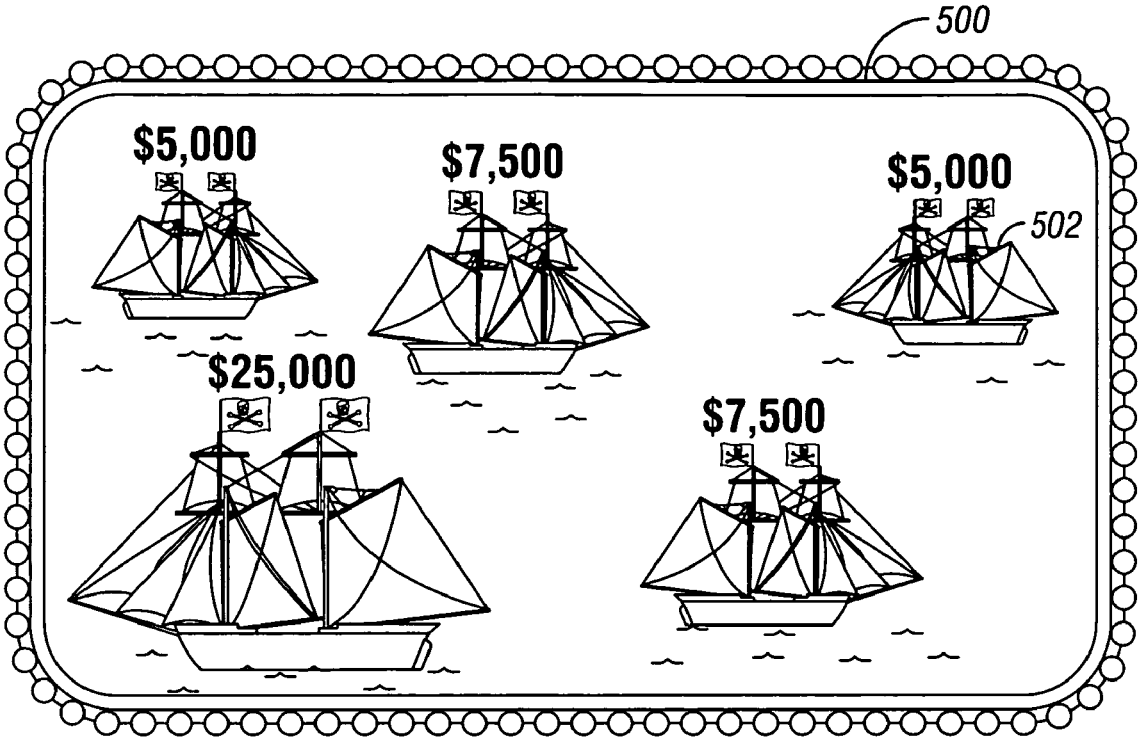
FIGS. 5A-5B illustrate another exemplary signage showing reapportioned awards according to one embodiment of the invention.
Figure 5B:
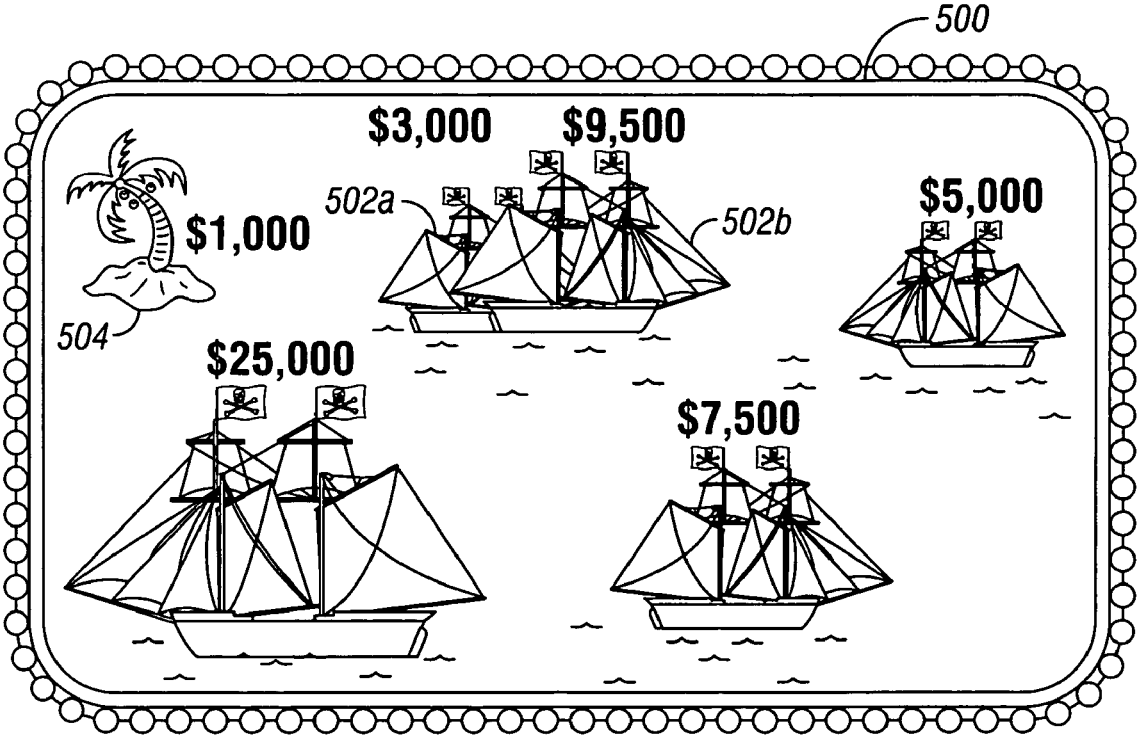

An exemplary implementation in which the players are allowed to select a reapportioned award 310*a-e* is illustrated in FIGS. 5A-5B. Here, the reapportioned awards 310*a-e* are displayed on signage 500 as pirate ships 502, with each pirate ship 502 representing one of the available reapportioned awards 310*a-e*. Each time a winning outcome corresponding to the contributed award 308*a-e* is achieved, the bank controller 304 allows the player to randomly select one of the pirate ships 502. There are many ways to implement the selection process (e.g., by sighting one of the pirate ships 502 through a telescope) and the specific implementation is not overly important to the practice of the invention. As in the implementation of FIG. 4, no shuffling or reapportioning of the reapportioned awards 310*a-e* is needed, although it may be desirable to regularly or irregularly reapportion the awards 310*a-e*.

In some embodiments, the reapportioning may be performed on-screen via some of the pirate ships 502 bumping into each other during the course of sailing around the signage 500 (see FIG. 5B). When this happens, the pirate ships (e.g., pirate ships 502*a* and 502*b*) may be shown to engage one another in a simulated battle, with the result that one pirate ship (e.g., pirate ship 502*a*) loses some of its value to the other pirate ship (e.g., pirate ship 502*b*).

It is also possible to combine the pooling of the awards with other features of the wagering game terminals 100*a-e*. For example, in one implementation, the pooling of the awards may be combined with a progressive jackpot where a credit amount equal to a percentage of the coin-in from each wagering game terminal 100*a-e* may be contributed to the award pool 306. The progressive jackpot may then be randomly divided amongst the different reapportioned awards 310*a-e*, as illustrated in FIG. 5B. Here, the progressive jackpot is displayed on the signage 500 as an island 504 to which the various pirate ships 502 may randomly visit. When a pirate ship 502 visits the island 504, a randomly selected portion of the value of the island 504 is transferred to the pirate ship 502. Thus, the value of the island 504 may change according to the amount of credits randomly transferred to the visiting pirate ships 502 (and also according to the amount of coin-in contributed).

Figure 6:
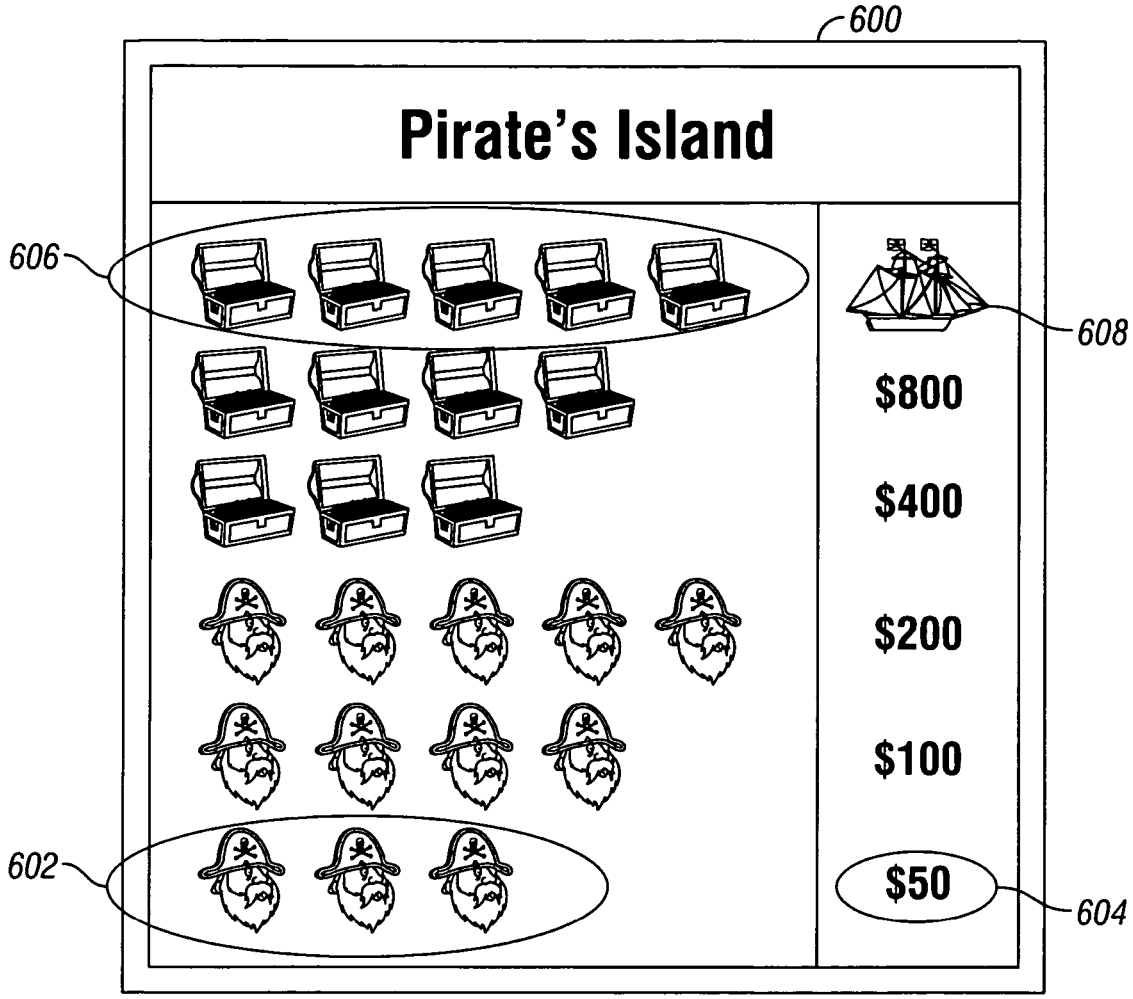
FIG. 6 illustrates an exemplary pay table that may be used with reapportioned awards according to one embodiment of the invention.

Alternatively, the island 504 may represent a portion of the award pool 306 that is kept in reserve for varying the values of the pirate ships 502. From time to time, the pirate ships 502 may visit the island 504 to bury their treasures (in which case the value of the pirate ships 502 decrease) or to find buried treasures (in which case the value of the pirate ships 502 increase).

Where the contributed awards 308*a-e* are pay table awards, a symbol or variable may be used instead of a fixed amount to represent the awards on the pay table. FIG. 6 illustrates an exemplary pay table 600 that may be displayed on the wagering game terminals 100*a-e* according to embodiments of the invention. As can be seen, the pay table 600 is similar to conventional pay tables in that one side of the pay table 600 shows the various symbol combinations 602 along a payline (or perhaps a scatter payout) that a player may achieve, while the other side of the pay table 600 shows the specific credit amounts 604 that are associated with the symbol combinations 602.

Unlike conventional pay tables, however, the top symbol combination 606 of the pay table 600 does not have a specific credit amount associated therewith. Instead, the pay table 600 employs a symbol 608 (e.g., a pirate ship) to indicate a variable credit amount. The symbol 608 tells the player that a reapportioned award 310*a-e* is associated with that symbol combination 606, and that the player will receive a credit amount that may vary according to whichever reapportioned award 310*a-e* is assigned to his or her wagering game terminal 100*a-e* when the symbol combination 606 is achieved. Of course, it is possible to associate the symbol 608 with a different symbol combination besides the top symbol combination 606 for each wagering game terminal 100*a-e* without departing from the scope of the invention.

In some embodiments, the original or published award 308*a-e* (i.e., the credit amount contributed to the award pool 306) associated with the symbol combination 606 may be hidden so as to avoid potentially discouraging or upsetting the players should the reapportioned award 310*a-e* turn out to be less than the published award 308*a-e*.

Figure 7A:
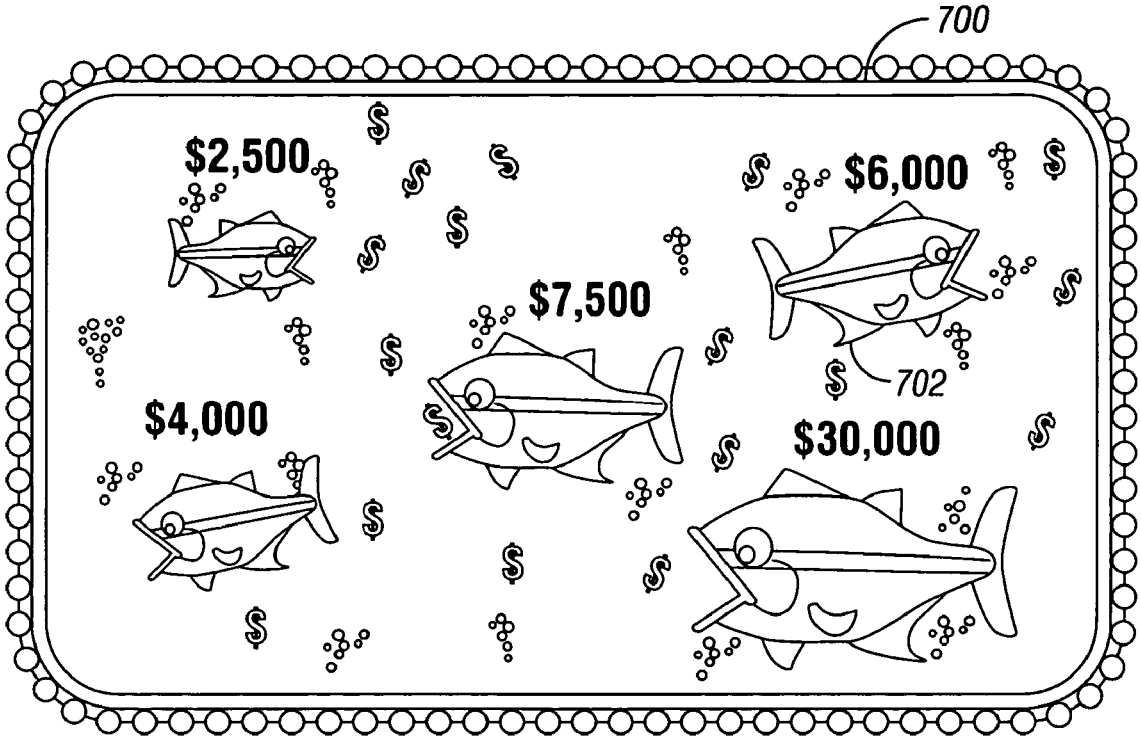
FIGS. 7A-7B illustrate yet another exemplary signage showing reapportioned awards according to one embodiment of the invention.
Figure 7B:
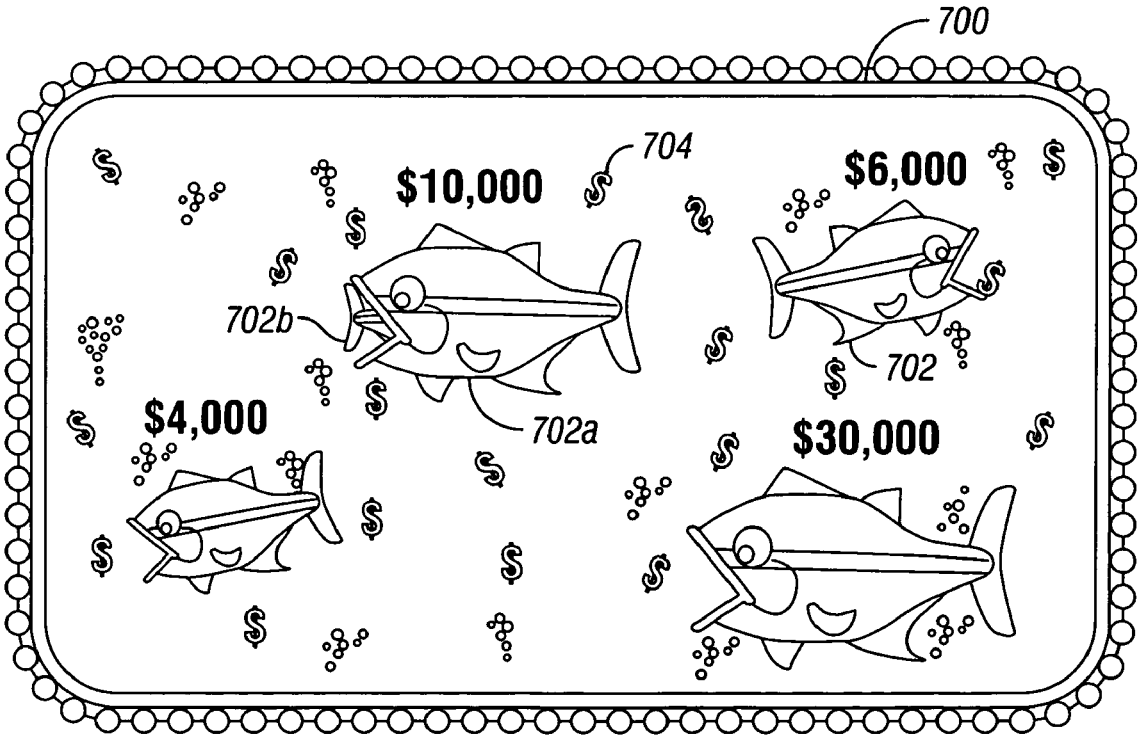

FIGS. 7A-7B illustrate another exemplary implementation in which the players are allowed to select the reapportioned award 310*a-e*. In the present case, the reapportioned awards 310*a-e* are displayed on signage 700 as fish 702, with each fish 702 representing one of the available reapportioned awards 310*a-e*. Each time an appropriate winning outcome is achieved, the bank controller 304 allows the player to randomly select one of the fish 702, for example, by randomly casting a fishing line and reeling in the fish 702. After the fish 702 is reeled in, the bank controller 304 provides a replacement fish 702 that is identical to the reeled-in fish so that other players may have an equal chance of catching the same fish 702.

As before, the reapportioning may be performed on-screen when the fish 702 bump into each other during the course of swimming around the signage 700 (see FIG. 7B). When this happens, some of the fish (e.g., fish 702*a* and fish 702*b*) may be shown in a simulated fight, with the result that one fish (e.g., fish 702*a*) may partially or wholly absorb the value of another fish (e.g., fish 702*b*). In the latter case, the number of fish 702 and, hence, the number of available reapportioned awards 310*a-e*, is reduced by one. However, because the total credit amount in the award pool 306 remains equal to the credit amount originally contributed, no expected value is lost over time for any wagering game terminal 100*a-e* or for the entire bank 300 of wagering game terminals 100*a-e*.

A progressive jackpot may also be added to the award pool 306 of the present embodiment and randomly divided amongst the different reapportioned awards 310*a-e* (i.e., fish 702). This can be seen in FIG. 7B, where the progressive jackpot is displayed on the signage 700 in the form of dollar-shaped pieces of fish food 704. Each dollar-shaped piece of fish food 704 represents a random credit amount that all the fish 702 may gain by eating. When a fish 702 eats a dollar-shaped piece of fish food 704, the credit amount represented by that dollar-shaped piece of fish food 704 is added to the size of the reapportioned award 310*a-e* represented by that fish 702.

In some embodiments, instead of a progressive jackpot, the dollar-shaped pieces of fish food 704 may represent portions of the award pool 306 that are kept in reserve for increasing the value of the fish 702. When a fish 702 eats a dollar-shaped piece of fish food 704, the credit amount represented by that dollar-shaped piece of fish food 704 is added to the size of the reapportioned award 310*a-e* represented by that fish 702.

Where the wagering game terminals 100*a-e* contribute awards 308*a-e* that have different credit amounts, an algorithm or set of rules may be used to normalize the reapportioned awards 310*a-e*. For example, wagering game terminals 100*a-e* that contribute awards 308*a-e* having higher credit amounts may be given multiple reapportioned awards 310*a-e* to compensate for the disparity. Referring back to FIG. 6, in one embodiment, wagering game terminals 100*a-e* that contribute higher awards 308*a-e* may display more than one pirate ship symbol 608 as the variable award on the pay table 600. Alternatively, the additional pirate ship symbol(s) 608 may "sail" between the various wagering game terminals 100*a-e*, with wagering game terminals 100*a-e* that have contributed higher awards 308*a-e* being more likely to receive an additional pirate ship symbol(s) 608. If a player achieves an appropriate winning outcome while the additional pirate ship symbol(s) 608 is docked at his or wagering game terminal 100*a-e*, the player is awarded the multiple reapportioned awards 310*a-e*.

Normalization may also be achieved by creating a significantly greater number of reapportioned awards 310*a-e* than contributed awards 308*a-e* in the award pool 306. However, to keep the total credit amount in the award pool 306 fixed, the greater number of reapportioned awards 310*a-e* in this embodiment must have significantly smaller credit amounts than those of the previous embodiments. Thus, in one implementation, each reapportioned award 310*a-e* may be based on a multiple of the lowest common denominator from among the various contributed awards 308*a-e*. Then, wagering game terminals 100*a-e* that have contributed higher awards 308*a-e* may be assigned more reapportioned awards 310*a-e* by the bank controller 304 or through selection by the player. The multiple reapportioned awards 310*a-e* thereafter take place of the contributed award 308*a-e* in the basic game, the bonus game, or as a randomly awarded prize that is not directly related to the basic game or the bonus game.

Figure 8:
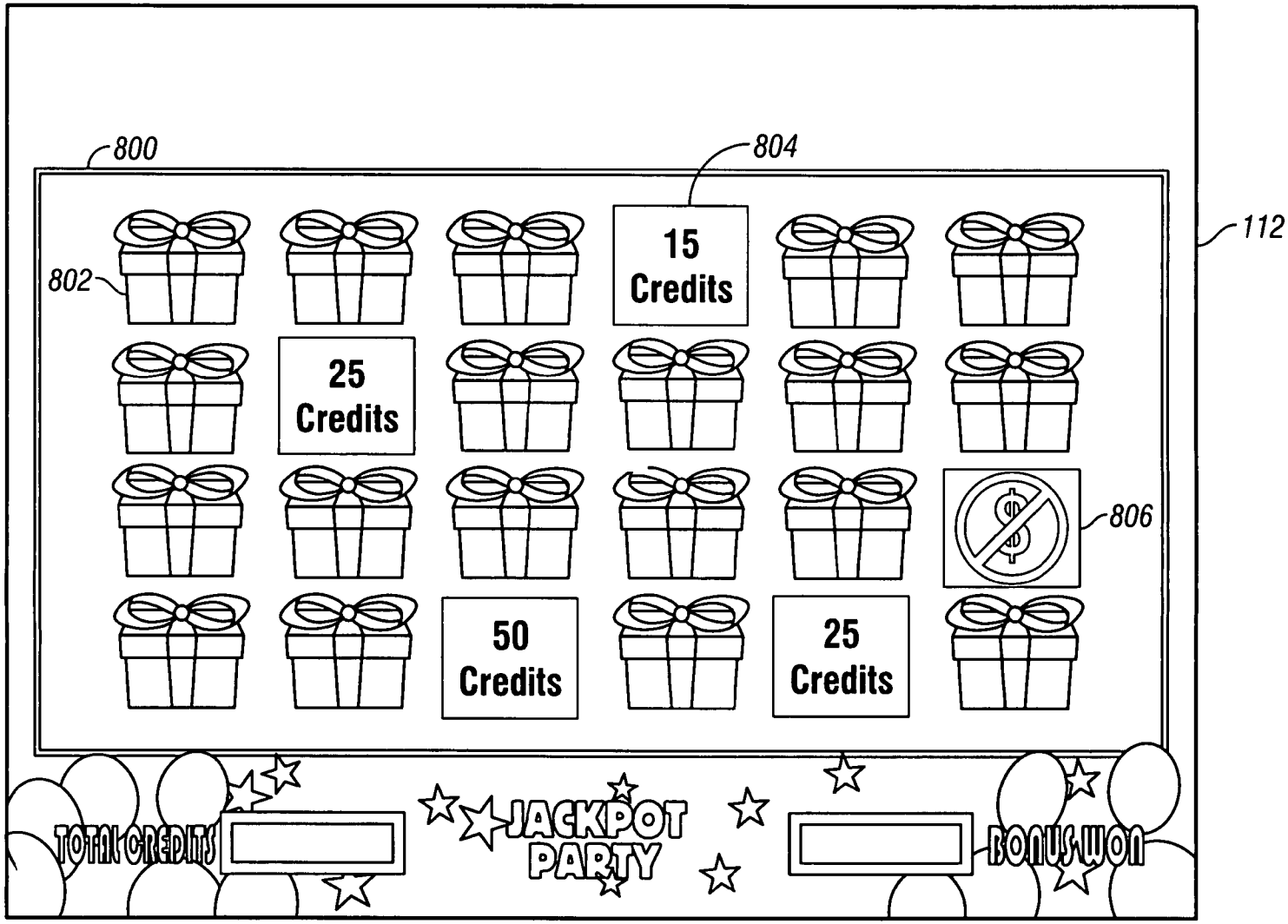
FIG. 8 illustrates an exemplary player-selection game that may be used to normalize reapportioned awards according to one embodiment of the invention.

In one implementation, the reapportioned awards 310*a-e* may be awarded via picks in a bonus game, such as a player-selection game. An example of such a player-selection game, called "Jackpot Party," is illustrated in FIG. 8. As can be seen, the player-selection game includes an array 800 of presents 802 displayed on the main display 112 or the secondary display 114 of a wagering game terminal 100*a-e*. Each present 802 reveals either a credit amount 804 or a game termination symbol 806 when selected. Each credit amount 804 represents an individual reapportioned award 310*a-e* that is assigned to the player when revealed. If a game termination symbol 806 is revealed, the player-selection game is concluded and the player is returned to the previous game. Thus, in accordance with embodiments of the invention, multiple reapportioned awards 310*a-e* may be assigned to the wagering game terminal 100*a-e*.

Alternatively, where the number of reapportioned awards 310*a-e* is equal to the number of contributed awards 308*a-e* so that only one reapportioned award 310*a-e* is assigned to a wagering game terminal 100*a-e*, all the credit amounts 804 may add up to the one assigned reapportioned award 310*a-e*. Then, to normalize the reapportioned awards 310*a-e* between the various wagering game terminals 100*a-e*, the number of game termination symbols 806 is adjusted based on the contribution of wagering game terminal 100*a-e*. Thus, players at wagering game terminals 100*a-e* that have contributed a larger award 308*a-e* to the award pool 306 will have fewer game termination symbols 806 and, hence, a greater chance of prolonging the player-selection game and winning more credits.

Embodiments of the invention are not limited to the player-selection game, however, and many alternative implementations exist. For example, in some embodiments, the reapportioned awards 310*a-e* may be awarded upon completion of a certain task, such as collection of certain game assets (e.g., keys, arrows, wild symbols, etc.) or by simply completing the game. Normalization may then be implemented by making it easier or more difficult for players at higher or lower contributing wagering game terminals 100*a-e*, respectively, to accomplish the task based on the credit amount contributed.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A wagering game system, comprising:

a network;

a plurality of wagering game terminals connected to said network, each wagering game terminal being capable of conducting a wagering game in which an outcome is randomly selected from a plurality of outcomes, each wagering game terminal contributing a predetermined award to said network, each of said predetermined awards being associated with at least one of said plurality of wagering game outcomes; and a network controller operable to aggregate said predetermined awards contributed by said wagering game terminals into an award pool having a total aggregated award value, said network controller being configured to reapportion said awards and to randomly assign reapportioned ones of said awards to said wagering game terminals;

wherein said network controller reapportions said awards by increasing a credit amount of some awards and decreasing a credit amount of other awards while keeping said total aggregated award value of said award pool fixed.

2. The wagering game system according to claim 1, wherein said network controller randomly assigns said reapportioned ones of said awards to said wagering game terminals substantially simultaneously.

3. The wagering game system according to claim 2, wherein said network controller is configured to randomly reassign said reapportioned ones of said awards on a regular or an irregular basis.

4. The wagering game system according to claim 1, wherein said network controller randomly assigns said reapportioned ones of said awards to said wagering game terminals only when one of said awards in said award pool is achieved by a player during said wagering game.

5. The wagering game system according to claim 1, wherein said network controller is configured to reapportion said awards in said award pool each time a wagering game terminal is connected to or removed from said network.

6. The wagering game system according to claim 1, wherein each wagering game terminal has a substantially equal chance of being assigned any reapportioned award.

7. The wagering game system according to claim 1, further comprising signage coupled to said network controller for displaying said reapportioned ones of said awards, said signage mounted in a location that allows players at said wagering game terminals to observe said signage.

8. A method of increasing volatility in wagering game terminals, each of said wagering game terminals being configured to conduct a wagering game in which an outcome is randomly selected from a plurality of outcomes, the method comprising:

pooling awards contributed from said wagering game terminals into an award pool having a total contributed award value, each of said contributed awards being associated with at least one of said plurality of outcomes;

reapportioning, via at least one controller associated with the wagering game terminals, said awards in said award pool such that some of the awards are increased while other ones of the awards are decreased, but said total contributed award value of said award pool remains fixed; and randomly selecting, via at least one controller, reapportioned ones of said awards for said wagering game terminals such that each wagering game terminal may receive a reapportioned award that is less than, the same as, or greater than an award contributed by said wagering game terminal.

9. The method according to claim 8, wherein said step of randomly selecting reapportioned ones of said awards includes receiving input from a player of said wagering game terminal.

10. The method according to claim 8, wherein said step of reapportioning produces the same number of reapportioned awards as awards contributed to said award pool.

11. The method according to claim 8, wherein said step of reapportioning produces a different number of reapportioned awards as awards contributed to said award pool.

12. The method according to claim 8, wherein said step of reapportioning results in no change to a payout percentage of said wagering game terminals.

13. The method according to claim 8, wherein all wagering game terminals contribute the same award.

14. The method according to claim 8, wherein at least one wagering game terminal contributes a different award.

15. The method according to claim 14, further comprising normalizing said reapportioned ones of said awards according to a credit amount contributed by each wagering game terminal.

16. The method according to claim 8, wherein said predetermined award contributed by each wagering game terminal is a highest award for said wagering game terminal.

17. The method according to claim 8, further comprising setting a lower credit amount limit and/or an upper credit amount limit for said reapportioned ones of said awards.

18. The method according to claim 8, further comprising combining a progressive jackpot with said award pool, wherein randomly selected portions of said progressive jackpot may be added to said reapportioned ones of said awards.

19. The method according to claim 8, wherein said awards correspond to a predetermined winning outcome for each wagering game terminal.

20. A non-transitory computer readable medium encoded with instructions which, when executed by one or more processors, cause a network controller to perform operations associated with wagering game terminals, each of said wagering game terminals being configured to conduct a wagering game in which an outcome is randomly selected from a plurality of outcomes, the operations comprising:

pooling awards contributed by said wagering game terminals into an award pool having a total contributed award value, each of said contributed awards being associated with at least one of said plurality of outcomes;

reapportioning said awards in said award pool such that some of the awards are increased while other ones of the awards are decreased, but said total contributed award value of said award pool remains fixed; and randomly selecting reapportioned ones of said awards for said wagering game terminals such that each wagering game terminal may receive a reapportioned award that is less than, the same as, or greater than the respective award contributed by said wagering game terminal.

21. The wagering game system according to claim 1, wherein said wagering game includes a pay table including said predetermined award contributed by each of said wagering game terminals.

22. The method according to claim 8, wherein said wagering game includes a pay table including said predetermined award contributed by each of said wagering game terminals.

* * * * *